US007445648B2

(12) United States Patent
Hudson et al.

(10) Patent No.: US 7,445,648 B2
(45) Date of Patent: Nov. 4, 2008

(54) WAX BLENDS FOR CANDLES WITH IMPROVED PROPERTIES

(75) Inventors: Carl Wayne Hudson, Woolwich Township, NJ (US); Christopher Jeffrey Kent, Paulsboro, NJ (US); Anthony Patrick Hennessy, Epsom (GB)

(73) Assignee: ExxonMobil Research and Engineering Company, Annandale, NJ (US)

( * ) Notice: Subject to any disclaimer, the term of this patent is extended or adjusted under 35 U.S.C. 154(b) by 670 days.

(21) Appl. No.: 10/943,736

(22) Filed: Sep. 17, 2004

(65) Prior Publication Data

US 2005/0086853 A1 Apr. 28, 2005

Related U.S. Application Data

(60) Provisional application No. 60/513,866, filed on Oct. 23, 2003.

(51) Int. Cl.
*C10L 5/00* (2006.01)

(52) U.S. Cl. ..... 44/275; 206/21

(58) Field of Classification Search ..... 44/275; 208/21

See application file for complete search history.

(56) References Cited

U.S. PATENT DOCUMENTS

| | | | | | |
|---|---|---|---|---|---|
| 3,046,101 | A * | 7/1962 | Tench | 44/275 |
| 3,069,346 | A * | 12/1962 | Tench | 208/21 |
| 3,356,469 | A | 12/1967 | Stephenson et al. | 44/6 |
| 4,224,204 | A | 9/1980 | Nichols et al. | 260/23 H |
| 4,855,098 | A | 8/1989 | Taylor | 264/103 |
| 6,534,573 | B1 | 3/2003 | Mace et al. | 524/277 |
| 2002/0040863 | A1 | 4/2002 | Cody et al. | 208/18 |
| 2003/0101640 | A1 | 6/2003 | Wood et al. | 44/275 |

* cited by examiner

*Primary Examiner*—Cephia D Toomer
(74) *Attorney, Agent, or Firm*—Estelle C. Bakun

(57) ABSTRACT

The present invention relates to a set of wax parameter specifications that will produce candles with improved properties. Specifically, the present invention relates to a blend of waxes that produces container candles with surprising properties and eliminates or minimize the use of costly microwax, polymers or additives. More specifically, this invention relates to a blend for and method of producing container candles that demonstrates the improved properties of low shrinkage, little oil bleed, enhanced opaqueness and creamy appearance and enhanced fragrance retention.

11 Claims, 6 Drawing Sheets

WAX BLENDS FOR CANDLES WITH IMPROVED PROPERTIES

This application claims the benefit of U.S. Ser. No. 60/513,866 filed Oct. 23, 2003.

FIELD OF INVENTION

The present invention relates to a set of wax parameter specifications that will produce candles with improved properties. Specifically, the present invention relates to a blend of waxes that produces container candles with surprising properties and eliminates or minimizes the use of costly additives. More specifically, this invention relates to a blend for and method of producing container candles that demonstrates the improved properties of low shrinkage, little oil bleed, enhanced opaqueness and creamy appearance and enhanced fragrance retention.

BACKGROUND OF INVENTION

Although candles have been produced for millennia, certain problems in candle production still remain. Specifically, candle producers desire candle waxes that demonstrate little or no shrinkage, little or no oil bleed, a pleasing and stable appearance and the ability to retain fragrance. Candles are traditionally made of petroleum derived waxes with mostly normal paraffin (n-paraffin) content, lower molecular weights, and therefore lower melting points. While candles with high n-paraffin content retain the proper color and texture desired by candle makers, they are often plagued by excessive shrinkage and poor fragrance retention.

While all of the above properties are important to candle makers, the most important property is the melting point of the wax. Candle makers use Fully Refined Waxes ("FRW"), which usually have less than 1% oil content, as the largest, if not only, wax type in their candles. On occasion, candle makers add microwax or polymers, to enhance the candle's properties, but these additives are costly relative to the wax. Low Melting ("LM") point wax usually melts at 128° F. (53° C.) or less. Waxes of this type are typically used for container candles, i.e., religious novena candles and decorative, fragranced jar candles. Typically LM FRW is gray in appearance and demonstrate relatively high shrinkage. Mid Melting ("MM") point waxes usually melt between 128 and 145° F. (53-63° C.) and are often used for higher quality container candles and free standing candles. MM RHC™ FRW are gray in appearance and demonstrate only slightly less shrinkage than LM FRW.

High Melting ("HM") point waxes, melting at greater than 145° F. (63° C.), are not commonly used in the candle industry. While waxes of this type typically demonstrate less shrinkage than either LM or MM RHC™ waxes, other significant disadvantages have prevented their use in the candle industry. HM FRW waxes are not used as candles because they exhibit a "tunneling" effect. That is, the candle burns straight down into the candle, leaving walled sides. The tunneling effect has proven highly commercially unattractive for both jar and stand-alone candles. The tunneling effect is caused because the "pool" of liquid wax that forms on the top surface of a burning candle does not extend far from the flame, due to the high melting point of the wax. Thus, the candle tends to be consumed unevenly, carving out a cylinder in the center of the candle. A solution to this problem would be to use a larger wick, but this produces a larger and higher flame—again a commercially unattractive option.

Shrinkage is a common problem experienced in candle manufacture. As a molten candle wax solidifies, the volume shrinks. In some cases this shrinkage can be beneficial, for example in helping a poured candle pull away from the sides of a mold making it easier to remove. However, wax shrinkage usually produces an unwanted concave effect on the top of the candle. Candle manufacturers must often re-melt the top portion of the candle or even resort to a second pouring of the candle wax formulation to level the top should excess shrinkage occur. In container candles, shrinkage can lead to candle separation from the side of the container—another undesired effect. Shrinkage has been directly linked to the amount of n-paraffin in the candle wax. Candle waxes containing about 100% n-paraffin will shrink approximately 12 to 15% by volume on cooling. Candle waxes containing about 75% n-paraffin will shrink approximately 8 to 12% by volume on cooling. Candle waxes containing about 50% n-paraffin will shrink approximately 6 to 8% by volume on cooling.

Several methods have been developed in an effort to control excessive shrinkage in container candles. Typically shrinkage is controlled by introducing components that will disrupt the n-paraffin crystal formation. Historically, the addition of high molecular weight isoparaffins (in the form of microwax or petrolatum), oxygenated molecules (such as carboxylic acids, carboxylate esters) and polyol structures have helped control shrinkage. However, these solutions are usually costly, can alter the color and texture of the candle, and, in some cases, raise the melting point to an unacceptably high level.

Another significant concern for candle makers is oil bleed. Oil bleed can be defined as the migration of oil or oil-type molecules out of and onto the surface of the solid wax. The appearance of oil on the wax candle surface is generally regarded as an unacceptable appearance phenomenon. The oil can be derived from the natural oil content of the petroleum wax or from added oily components in the candle formulation, including fragrance oils and carrier solvents for fragrance packages. Petroleum waxes of all types contain some amount of oil. Fully refined waxes have typically less than 1%, more often less -than 0.5%, oil content (as measured by the ASTM D-721 test method). Scale waxes are low oil content slack waxes. With further refinement to improve color and odor, typically by hydrotreatment, scale waxes can be upgraded to semi-refined waxes that can have from 1% to about 5% oil content (as measured by the ASTM D-721 test method). Semi-refined waxes have found limited use in container candles, in spite of their typically lower cost, because of a greater tendency to exhibit oil bleed in a formulated candle.

Historically, methods for improving oil bleed or fragrance hold in candle manufacture include:

1. addition of high molecular weight microwax (derived from bright stock),
2. addition of petrolatum (petroleum jelly),
3. addition of other additives, and
4. rigorous control of process conditions, such as cooling rates and sequences.

While helping to minimize oil bleed, the addition of microwax and modified waxes often causes additional problems of shrinkage (see above). The addition of petrolatum or petroleum jelly is relatively expensive and significantly softens the candle. Other additives can also be expensive and/or can negatively alter the appearance and shrinkage characteristics of the wax and candle formulation. Finally, varying the cooling rates and sequences is labor intensive and often varies with the slightest difference in the underlying candle wax.

Another important attribute for candle manufacturers is the color and uniformity of the raw candle. The impact of raw wax color and appearance on the final candle formulation can be significant. For example, a translucent gray LM fully refined wax will provide a different appearance in a given candle formulation than higher melting, more isoparaffinic wax that has a more cloudy, white-gray appearance. Candle makers typically formulate for a given type of base wax and strive to maintain a consistent color and appearance for each candle formulation. A wax that exhibits a rich, creamy opaque whiteness can provide the candle maker with new and improved options for candle formulation.

SUMMARY OF INVENTION

Figure 1:
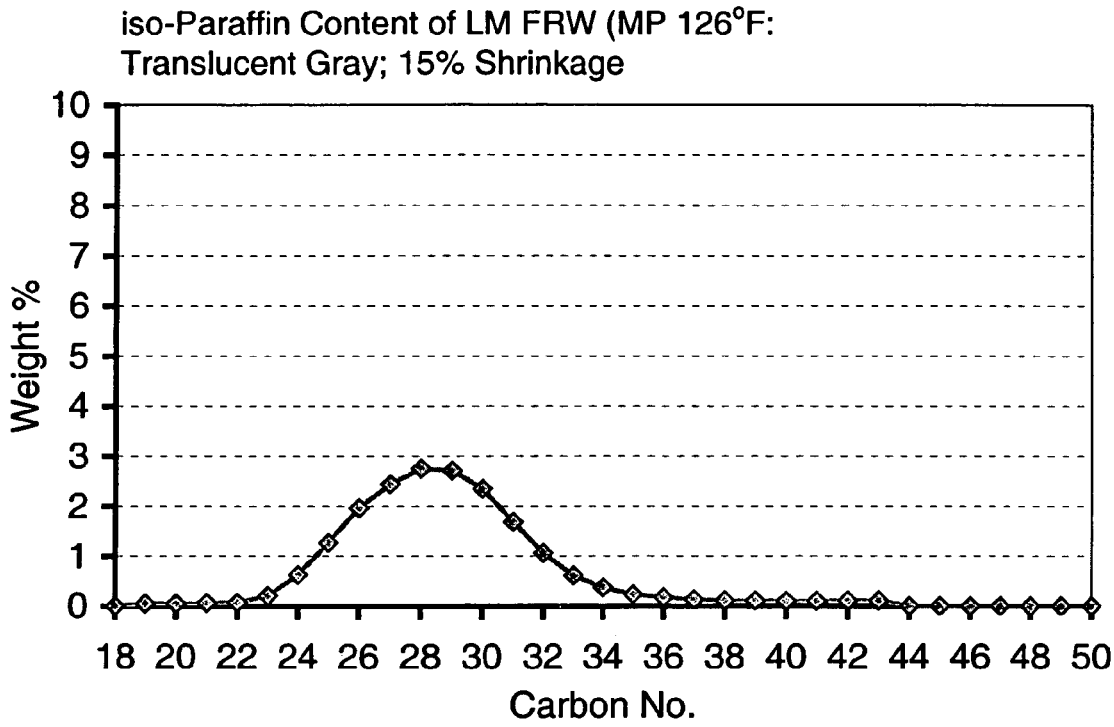
FIG. 1 is a graphical representation of the Carbon number versus the iso-paraffinic weight percentage at that carbon number for a typical low melting point fully refined wax with a melting point of 126° F.

The present invention comprises a method to produce candles of low shrinkage, low oil bleed, good color and texture and expected superior fragrance retention (due to the low bleed) comprising blending a wax composition such that isoparaffinic content of the original paraffinic wax is increased for carbon numbers between 35 and 60, but not increased by more than about 0.1 wt % for carbon numbers greater than 60 at a given carbon number, and the products produced by this method.

Preferably, the present invention is a wax blend comprising blending a wax composition such that isoparaffinic content of the original paraffinic wax is increased for carbon numbers between 36 and 57, but not increased by more than about 0.1 wt % for carbon numbers greater than 57 at a given carbon number, and the products produced by this method. More preferably, the present invention is a wax blend comprising blending a wax composition such that isoparaffinic content of the original paraffinic wax is increased for carbon numbers between 37 and 55, but not increased by more than about 0.1 wt % for carbon numbers greater than 55 at a given carbon number, and the products produced by this method. Even more preferably, the present invention is a wax blend comprising blending a wax composition such that isoparaffinic content of the original paraffinic wax is increased for carbon numbers between 37 and 50, but not increased by more than about 0.1 wt % for carbon numbers greater than 50 at a given carbon number, and the products produced by this method.

In another embodiment, the present invention comprises a product that exhibits low shrinkage, low oil bleed, good color and texture and superior fragrance retention comprising:

a) about 75-95 wt % of a first wax having
   1. a melting point of between about 128° F. to about 145° F.;
   2. an oil content of between about 1 wt % to about 10 wt %;
   3. a total paraffins average carbon number of between about 29-33;
   4. an iso-paraffin average carbon number of between about 30-34;
   5. about 43-57 wt % n-paraffins;
   6. a 95% carbon # spread of 12-16;
   7. with the wt % of C24 or less being less than about 10%;
   8. with the wt % of C34 or greater being less than about 30%;
   9. with the wt % of C38 or greater being less than about 10%; and b) the remainder being a second wax having
   1. a melting point greater than about 152° F.;
   2. an oil content of less than about 1 wt %;
   3. a total paraffins average carbon number of between about 36-40;
   4. an iso-paraffin average carbon number of between about 38-42;
   5. about 43-57 wt % n-paraffins;
   6. a 95% carbon # spread of 19-25;
   7. with the wt % of C24 or less being less than about 5%;
   8. with the wt % of C34 or greater being greater than about 60%; and
   9. with the wt % of C38 or greater being greater than about 40%.

A preferred form of this embodiment would be a wax blend wherein the first wax was provided as about 80 to 92.5 wt % of the total blend. A more preferred form of this embodiment would be a wax blend wherein the first wax was provided as about 85 to 90 wt % of the total blend. An alternate embodiment comprises any of the embodiments that varied the amount of the first wax in the wax blend where the melting point of the first wax was preferably about 129° F. to about 140° F., and more preferably the melting point of the first wax was preferably about 131° F. to about 139° F. Another alternate embodiment encompasses any of the changes to the amount of the first wax in the final blend or the properties of the first wax listed above and preferably modifying the oil content of the first wax to be between about 1 wt % to about 7 wt %, more preferably between about 1 wt % and about 5 wt %. Another alternate embodiment of this embodiment encompasses any of the modifications to the first wax noted above and modifying the melting point of the second wax such that it is preferably greater than about 154° F., more preferably greater than about 156° F. Another alternate embodiment of this embodiment encompasses any of the modifications noted above to either the first or second wax and further modifying the second wax such that it preferably has an oil content of less than about 0.75 wt %, more preferably less than about 0.5 wt %.

As used in this specification, the oil content of a wax is determined using test method ASTM D-721. As used within this specification the total amounts of paraffins and iso-paraffins at a carbon number is determined by the ASTM D-5442 Analysis of Petroleum Waxes by Gas Chromatography ("GC") or an equivalent gas chromatography method. From these GC methods one of ordinary skill in the art is able to determine the weight percentages by standard integration techniques. A 95% carbon number spread between X and Y means that 95% of the carbon molecules (by weight) have a carbon number between the number X and the number Y.

In another embodiment, the present invention comprises a product that exhibits low shrinkage, low oil bleed, good color and texture and superior fragrance retention comprising about 75-95 wt %, preferably about 80-92.5 wt %, more preferably about 85-90 wt % of a midmelting point same refined wax produced by the ExxonMobil Raffinate Hydroconversion Process ("RHC™") with the remainder being a high melting point fully refined wax.

DETAILED DESCRIPTION OF INVENTION

Traditionally candles have been made of petroleum derived Fully Refined Waxes (FRW) of different melting points. FRW are classified by their melting points. Those which melt at less than 128° F. (53° C.) are classified as Low Melting Point Fully Refined Waxes (LM FRW). Those which melt at between 128 to 145° F. (53-63° C.) are classified as Mid Melting Point Fully Refined Waxes (MM FRW). Those which melt at greater than 145° F. (63° C.) are classified as High Melting Point Fully Refined Waxes (HM FRW).

FIG. 1 shows a wax GC plot of the iso-paraffin content for a typical low-melting point FRW (MP 126° F.) used in container candle applications. This wax, which can be found commercially as ParVan™ 1270, has approximately 20% iso-paraffins with an average carbon number of about 28. This wax is translucent gray in color and exhibits approximately 15% shrinkage. This wax also has limited oil hold capacity, and sometimes requires candle formulation adjustments in order to hold higher levels of fragrance.

Figure 2:
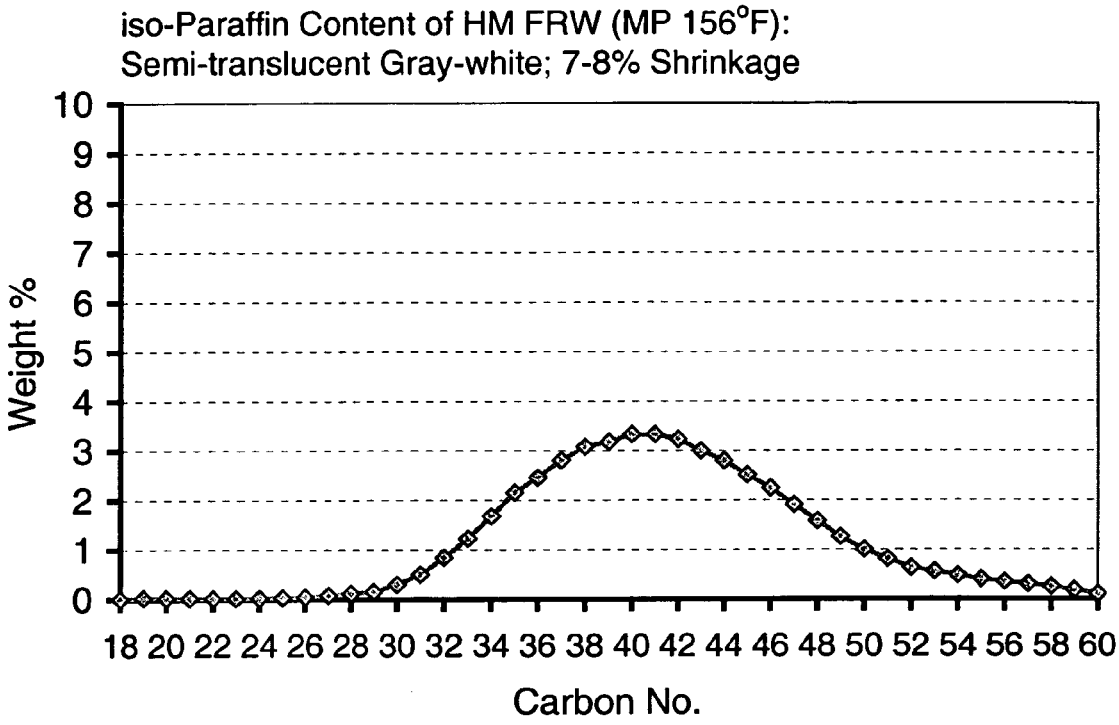
FIG. 2 is a graphical representation of the Carbon number versus the iso-paraffinic weight percentage at that carbon number for a typical high melting point fully refined wax with a melting point of 156° F.

FIG. 2 shows a wax GC plot of the iso-paraffin content for a typical high-melting point FRW (MP 156° F.). This wax, commercially known as ParVan™ 1580, has approximately 50% iso-paraffins with an average carbon number of about 36. This wax is cloudy, gray white in color and exhibits approximately 6-8% shrinkage. Because of the inherent high MP and a typically higher market price, this wax is not commonly used for candles.

Another type of wax, mid-melt point RHC™ waxes have not been considered acceptable for use in candles due to their high oil content (1%-4%) and resulting problems of oil bleed and fragrance retention.

In the RHC™ process, which is detailed in U.S. Pat. No. 5,976,353 and U.S. Pat. No. 5,935,417 and are hereby incorporated by reference, lube raffinate is passed over a metal sulfide hyproprocessing catalyst at relatively high temperature and pressure. Essentially all of the nitrogen and sulfur components of the feed stream are removed and a high percentage of the aromatic ring components are saturated to cyclo-paraffins. A limited amount of C—C bond cleavage (hydrocracking) also occurs in the RHC™ process. Collectively these changes in the raffinate feed stream provide lube basestock product with higher viscosity index and low aromatics levels, i.e., Group II basestocks.

Mid melt waxes separated from the RHC™ process has approximately 43%-57% iso-paraffins with an average carbon number of about 30-34. This wax is opaque-creamy white in color and exhibits exceedingly low shrinkage characteristics. Unfortunately, with its high oil content, the RHC™ wax was not useful for candles because it tended to demonstrate high oil bleed even before fragrance addition.

EXAMPLE 1

Hoping to take advantage of the low shrinkage and opaque white color characteristics of the MM RHC™ wax, while maintaining the low oil bleed and fragrance hold characteristics of the FRW, the inventors experimented with blends of the commercially available LM FRW 126, HM FRW 156 and MM RHC™ 135. The blends were selected to maintain a commercially viable final melting point and cost. Initial attempts to blend only a LM FRW wax and the MM RHC™ proved unsuccessful in controlling the oil bleed of the final blend. The inventors added a minor amount of a HM FRW 156 to the blends in an attempt to control the oil bleed by providing higher carbon number isoparaffins, similar to the effect expected from the addition of microwax but without the associated expense.

Figure 3:
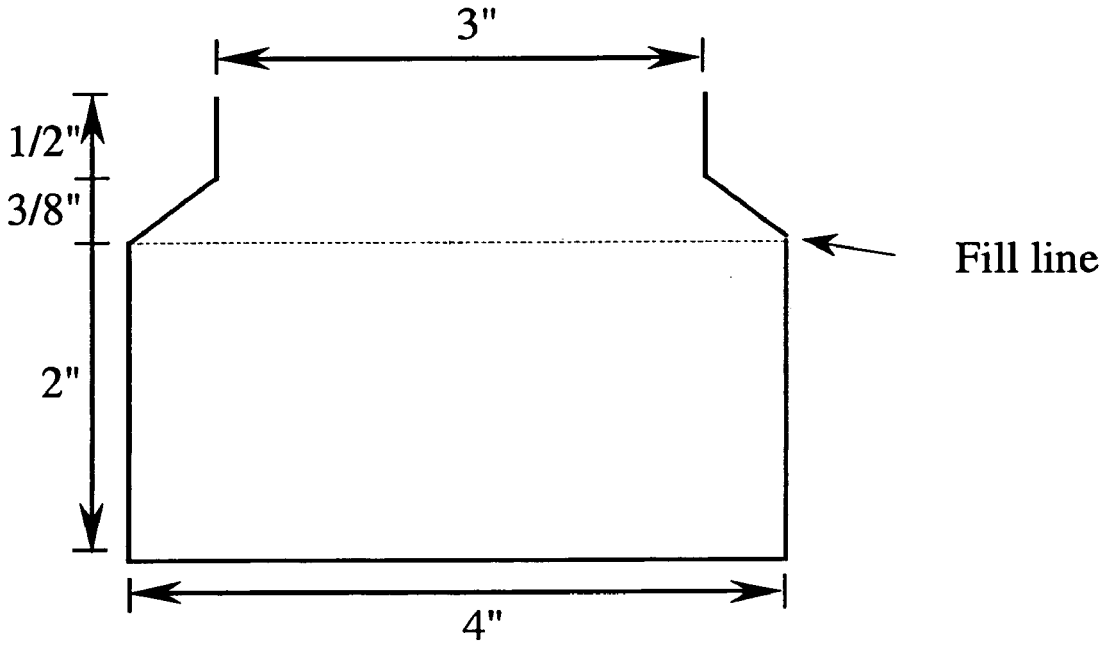
FIG. 3 is a drawing of the jar used for the shrinkage experiments.

The wax blends were evaluated for shrinkage, oil bleed and color. All samples in all of the examples were prepared in identical glass jars. The jars were of a "stovepipe" configuration as shown in FIG. 3. Shrinkage was determined by filling the jars with the liquid wax blend to the fill line, which was located at the lower elbow of the jar, approximately 2 inches (5 cm) above the base. The molten wax was allowed to solidify at ambient temperature. Measurements were made by using an apparatus that aligned a metal measuring rod perpendicularly over the top of the jar. The measuring rod was lowered to determine how far below the fill line the lowest point of the top surface of the candle had fallen during solidification. Shrinkage measurements were reported in units of 1/16th of an inch (1.59 mm).

The shape of the indentation is also reported. Conical means that the slope from the edge of the jar to the center was relatively constant. Concave means that the edge of the indentation was curved akin to a parabola. A sink hole means that part of the central portion of the indentation fell further and faster than the normal curvature, akin to a pothole or sinkhole. A center hump indicated that the indentation rose at the center. Oil bleed and color were determined by visual inspection. Surface oil means that small, typically pin-head sized, evenly spaced oil droplets were observed. Puddling means that larger, irregularly spaced drops typically greater than ¼" in diameter were observed.

Table 1 presents the results for various experimental blends. The blends shown in Table 1 were developed to meet a 130° F. MP typically used in container candles. As Table 1 demonstrates, no mixture of the three components performed adequately because there was significant shrinkage or oil bleed. For comparison, the shrinkage, oil bleed and appearance were determined for unblended FRW with melting points of 127° F. (52.7° C.) and 158° F. (70° C.) and an unblended MM HRC™ wax with a melting point of 135° F. (57.2° C.). These baseline characteristics are reported in Table 2.

EXAMPLE 2

A component study of the MM HRC™ 135, the LM FRW 126 and the HW FRW 156 using the same tests as used in the first example was conducted. Table 3 demonstrates the result that low shrinkage, low oil bleed and good color characteristics were found in a combination of the HM FRW 156 and the MM RHC™ 135 (blends 1168 and 1170). This result was surprising because, as noted above, one of ordinary skill in the art would not consider the use of HM FRW in a candle.

TABLE 1

| blend: | 1147 | 1148 | 1149 | 1150 | 1151 | 1152 | 1153 |
|---|---|---|---|---|---|---|---|
| MM RHC ™ (wt %) (MP 135° F.) | 25 | 35 | 30 | 30 | 40 | 50 | 60 |
| LM FRW (wt %) (MP 126° F.) | 72.5 | 60 | 60 | 65 | 50 | 40 | 30 |
| HM FRW (wt %) (MP 157° F.) | 2.5 | 5.0 | 10 | 5.0 | 10 | 10 | 10 |
| Total | 100 | 100 | 100 | 100 | 100 | 100 | 100 |
| Melting Point of Blend ° F. (° C.) | 126 (52.2) | 127 (52.7) | 128 (53.3) | 127 (52.7) | 129 (53.9) | 130 (54.4) | 131 (55.0) |
| Shrinkage in 1/16" (1.59 mm) | 5 | 5 | 10 | 5 | 7 | 9 | 10 |
| Top Surface Shape | Concave Center Hump | Concave | Conical | Concave | Concave | Concave Sink Hole | Concave Sink Hole |
| Oil Bleed | Surface Oil | Surface Oil and Puddling | None | Surface Oil and Puddling | Surface Oil and Puddling | Surface Oil and Puddling | Surface Oil and Puddling |
| Color and Texture | Cloudy Gray Smooth | Cloudy Gray Smooth | Cloudy Gray Smooth | Cloudy Gray Smooth | Cloudy Gray-White Smooth | Cloudy Gray-White Smooth | Cloudy Gray-White Smooth |

TABLE 2

| blend: | 02-9201 | 02-78026 | 03-3022 |
|---|---|---|---|
| ProWax ™ 320 (wt %) (MM RHC) (M.P. 135° F.) | — | — | 100 |
| PV 1270 (wt %) (LM FRW) (M.P. 127° F.) | 100 | — | — |
| PV 1580 (wt %) (HM FRW) (M.P. 158° F.) | — | 100 | — |
| Shrinkage in 1/16" (1.59 mm) | 10 | 5 | 2 |
| Top Surface Shape | Conical | Concave | Slightly Concave |
| Oil Bleed | None | None | Surface Oil and Puddling |
| Color and Texture | Translucent Gray Smooth | Translucent Gray Smooth | Opaque White Creamy Smooth |

EXAMPLE 3

The inventors were surprised by the results of the component study showing that a HM FRW and the MM HRC™ provided the inventive results of low shrinkage and no oil bleed without the addition of a LM FRW. However, striving for commercial acceptance, the inventors desired to find the lowest possible melting point FRW that could be used and still provide the present invention. However, as Table 4 demonstrates, the effect of low shrinkage, good color and no bleed retention is surprisingly only achieved with a mixture of the MM HRC™ and a HM FRW with a MP of greater than about 152° F. and at a 9:1 ratio.

While the free-standing candle industry traditionally has employed wax blends that have melting points closer to 145° F. for their candles, balancing the cost of the higher melting point waxes with the needs to have a more rigid candle better able to withstand the potentially higher temperatures during transportation and storage, the present invention can be of use in that market by using appropriate manufacturing techniques such as overdip or well-known hardening additives.

TABLE 3

| Blend: | 1166 | 1167 | 1168 | 1169 | 1170 |
|---|---|---|---|---|---|
| MM RHC ™ (wt %) (MP 135° F.) | 37 | — | 87.5 | 35 | 90 |
| LM FRW (wt %) (MP 126° F.) | 63 | 92 | — | — | — |
| MM FRW (wt %) (MP 138° F.) | — | — | — | 60 | — |
| HM FRW (wt %) (MP 156° F.) | — | 8 | 12.5 | 5.0 | 10 |
| Total | 100 | 100 | 100 | 100 | 100 |
| Shrinkage in 1/16" (1.59 mm) | 5 | 11 | 4 | 4 | 4 |
| Top Surface Shape | Concave Center Hump | Conical | Concave | Concave Center Hump | Concave |
| Oil Bleed | Surface Oil | None | None | Surface Oil and Puddling | None |
| Color and Texture | Cloudy Gray Smooth | Translucent Gray Smooth | Opaque White Creamy Smooth | Opaque White Creamy Smooth | Opaque White Creamy Smooth |

TABLE 4

| | Compositional Information (wt %) | | | | | | | | | | |
|---|---|---|---|---|---|---|---|---|---|---|---|
| | MM RHC | LM FRW | LM FRW | LM FRW M.P. | MM FRW | MM FRW | HM FRW | Shrink Depth | | | Color/ |
| Sample | 135° F. | 129° F. | 130° F. | 131° F. | 138° F. | 152° F. | 158° F. | (in 1/16") | Shape | Bleed | Texture |
| 1245 | 90 | 10 | | | | | | 12 | Concave, sink hole | Surface oil and puddling | cloudy gray, smooth |
| 1251 | 90 | | | 10 | | | | 12 | Concave, sink hole | Surface oil and puddling | cloudy gray, smooth |
| 1248 | 90 | | 10 | | | | | 10 | Concave, sink hole | Surface oil and puddling | cloudy gray, smooth |
| 1254 | 90 | | | | 10 | | | 9 | Concave, sink hole | Surface oil and puddling | cloudy gray, smooth |
| 1194 | 90 | | | | | 10 | | 5 | Concave, sink hole | Surface oil and puddling | cloudy gray, smooth |
| 1220 | 90 | | | | | | 10 | 5 | Concave | None | opaque white, creamy smooth |

TABLE 5

| Claimed Ranges for | MM RHC | HM FRW |
|---|---|---|
| Avg. Carbon # (Total Paraffins) | 29-33 | 36-40 |
| Avg. Carbon # (iso-Paraffin) | 30-34 | 38-42 |
| % n-Paraffin | 43-57 | 43-57 |
| 95% Carbon # Spread | 12-16 | 19-25 |
| % C24– | <10 | <5 |
| % C34+ | <30 | >60 |
| % C38+ | <10 | >40 |

Upon further analysis, the inventors realized that this surprising result would be produced by producing a wax blend of about 75-95 wt %, preferably about 80-92.5 wt %, more preferably about 85-90 wt % of a wax with parameters similar to those in Column A of Table 5, the remainder being a wax with parameters similar to those in Column B of Table 5.

EXAMPLE 4

Figure 4:
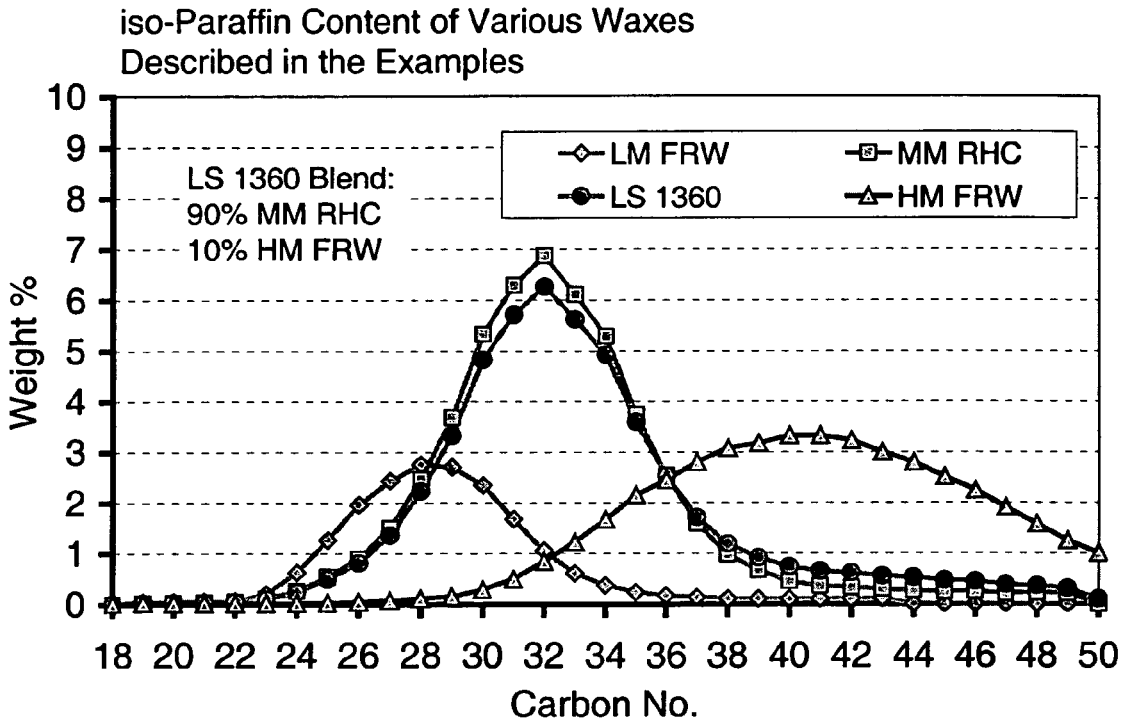
FIG. 4 is a graphical representation of the Carbon number versus the iso-paraffinic weight percentage at that carbon number for a low melting point fully refined wax (MP 126° F.), a high melting point fully refined wax (MP 156° F.), a mid melting point RHC™ wax (MP 135° F.) and a 90:10 blend of the high melting point fully refined wax and the mid melting point RHC™ wax (MP 136° F.) ("LS 1360").
Figure 5:
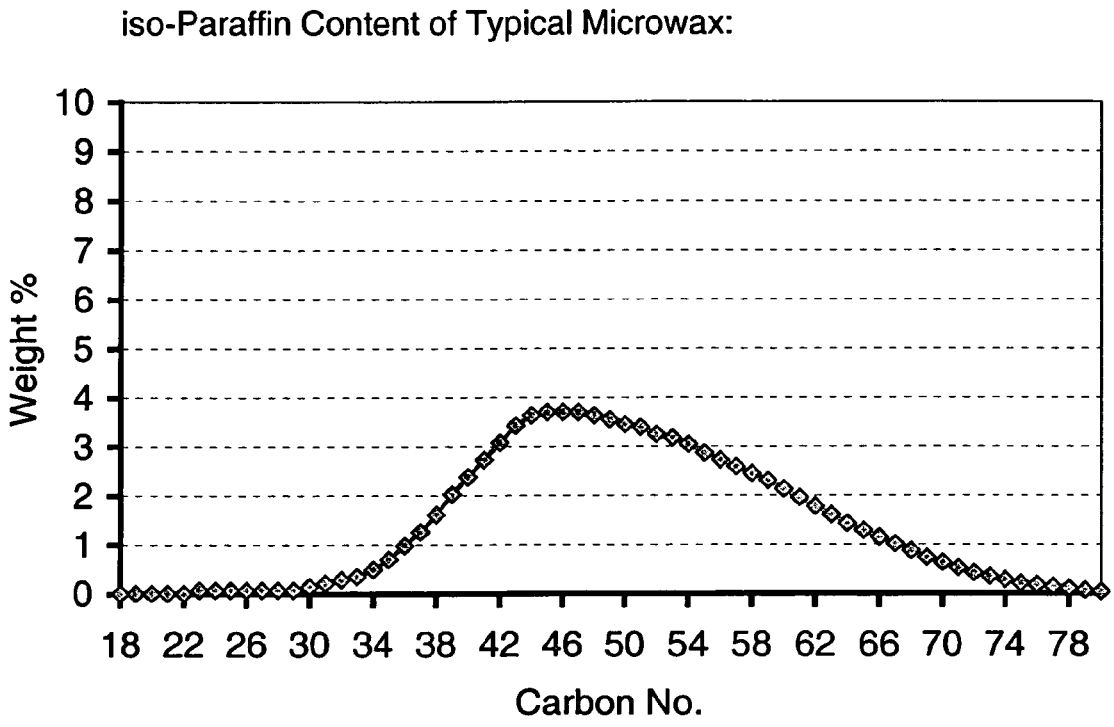
FIG. 5 is a graphical representation of the Carbon number versus the iso-paraffinic weight percentage at that carbon number for a typical microwax.

With further experimentation, the inventors realized that an increase in the wt % iso-paraffin for the carbon number from about 36 to about 60, preferably from about 36 to 57, more preferably from about 37 to 55 and even more preferably from about 37 to 50, without the attendant increases (greater than about. 1 wt %) in the same at carbon number greater than 60, preferably greater than 57, more preferably greater than 55, even more preferably greater than 50 produced the remarkable results of low shrinkage, little to no oil bleed, excellent color and expected excellent fragrance retention. Due to this unexpected result of Example 3, the inventors conducted additional gas chromatography experiments. FIG. 4 shows the weight % of isoparaffins in each wax at each carbon number for four waxes, a LM FRW 126, a MM RHC™ 135, a HM FRW 156 and for a 90:10 blend of the MM RHC™ 135 and the HM FRW 156.

Figure 6:
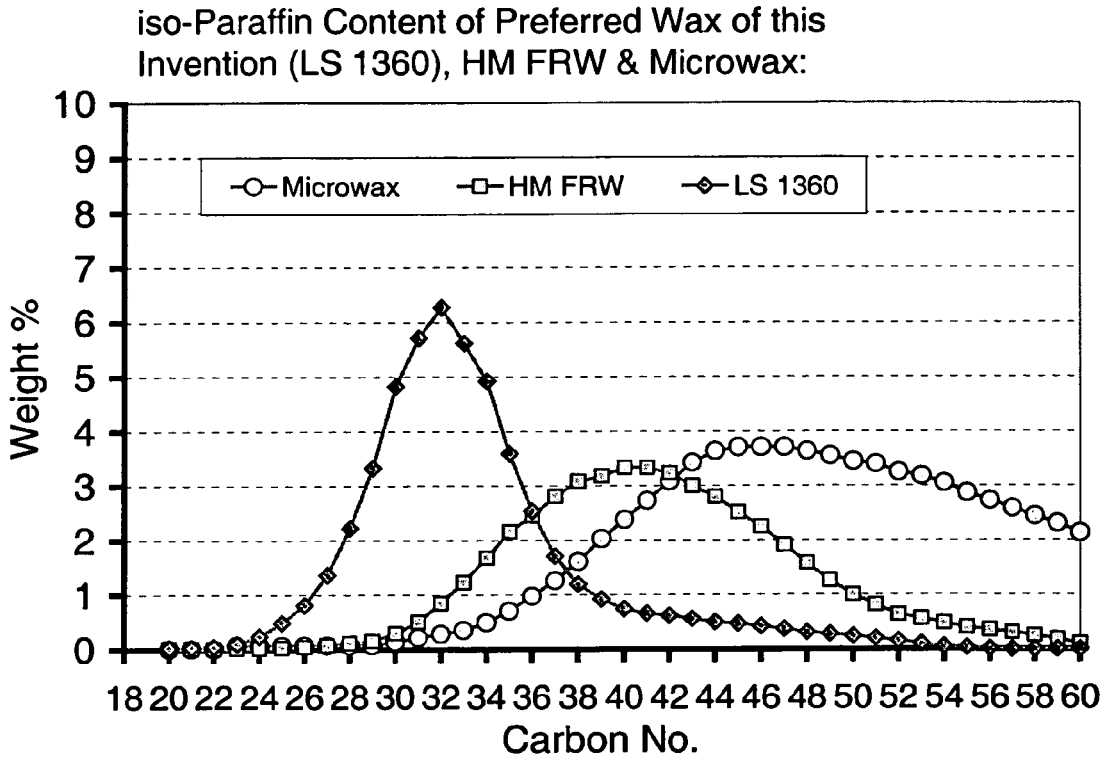
FIG. 6 is a graphical representation of the carbon number versus the iso-paraffinic weight percentage at that carbon number for the 90:10 blend ("LS 1360"), the High Melting Fully Refined Wax (MP 156) and a typical microwax.

The inventors noted that blend LS 1360 was very similar to MM HRC™ with one notable difference: the increase in the weight % iso-paraffins for carbon number from about 36 to about 60. The inventors compared this to a GC of microwax as shown in FIG. 6, as microwax was often used to control oil bleed but leads to shrinkage. FIG. 6 shows that microwax starts to show isoparaffins about carbon number 34 which increase steadily to carbon number 50 with approximately 40% of the iso-paraffins having a carbon number of 50 or greater. This experiment indicates that the advantages of less shrinkage and no oil bleed can be achieved when one does not follow the industry tradition of using microwax, which would increase the weight percentage of the isoparaffins with a carbon number of greater than 50 and in the final blend by more than about 0.1 wt % at a given carbon number.

What is claimed is:

1. A wax blend comprising:

(a) about 75-95 wt % of a first wax wherein said first wax has:

i) a melting point of between about 128° F. to about 145° F.;

ii) an oil content of between about 1 wt % to about 10 wt %;

iii) a total paraffins average carbon number of between about 29-33;

iv) an iso-paraffin average carbon number of between about 30-34;

v) about 43-57 wt % n-paraffins;

vi) a 95% carbon number spread of 12-16;

vii) the weight percent of said first wax's molecules having a carbon number of C24 or less being less than about 10%;

viii) the weight percent of said first wax's molecules having a carbon number of C34 or greater being less than about 30%;

ix) the weight percent of said first wax's molecules having a carbon number of C38 or greater being less than about 10%; and (b) the remainder being a second wax wherein said second wax has:

i) a melting point greater than about 152° F. ;

ii) an oil content of less than about 1 wt %;

iii) a total paraffins average carbon number of between about 36-40 iv) an iso-paraffin average carbon number of between about 38-42;

v) about 43-57 wt % n-paraffins;

vi) a 95% carbon number spread of 19-26;

vii) the weight percent of said second wax's molecules having a carbon number of C24 or less being less than about 5%;

viii) the weight percent of said second wax's molecules having a carbon number of C34 or greater being greater than about 60%; and ix) the weight percent of said second wax's molecules having a carbon number of C38 or greater being greater than about 40%.

2. The wax blend of claim 1 wherein said melting point of said first wax is between about 129° F. and about 140° F.

3. The wax blend of claim 1 wherein said melting point of said second wax is greater than about 156° F.

4. The wax blend of claim 1 wherein the oil content of the first wax is between about 1 wt % and about 7 wt %.

5. The wax blend of claim 1 wherein the oil content of the second wax is less than about 0.8%.

6. The wax blend of claim 1 wherein said first wax comprises about 80 to 92.5 wt % of the total blend.

7. The wax blend of claim 1 wherein said first wax comprises about 85 to 90 wt % of the total blend.

8. The wax blend of claim 1 wherein said melting point of said first wax is between about 131° F. and 139° F.

9. The wax blend of claim 1 wherein the oil content of the first wax is between about 1 wt % and about 5 wt %.

10. The wax blend of claim 1 wherein the oil content of the second wax is less than about 0.5 wt %.

11. The wax blend of claims 1, 2, 3, 4, 5, 6, 7, 8, 9 or 10 wherein said first wax is derived from the ExxonMobil Raffinate Hydroconversion Process™.

* * * * *